US005842593A

United States Patent [19]

von Holdt

[11] Patent Number: 5,842,593

[45] Date of Patent: Dec. 1, 1998

[54] TWO PART PLASTIC CONTAINER LID

[75] Inventor: John W. von Holdt, 6864 Lexington La., Niles, Ill. 60648

[73] Assignee: John W. Von Holdt, Niles, Ill.

[21] Appl. No.: 667,968

[22] Filed: Jun. 18, 1996

[51] Int. Cl.[6] ..... B65D 25/28

[52] U.S. Cl. ..... 220/212.5; 220/254; 220/266; 220/284; 220/634; 220/769; 220/773; 220/789

[58] Field of Search ..... 220/212.5, 254, 220/266, 276, 284, 634, 789, 760, 768, 769, 773

[56] References Cited

U.S. PATENT DOCUMENTS

| | | | |
|---|---|---|---|
| 3,119,541 | 1/1964 | Lynn . | |
| 4,210,258 | 7/1980 | von Holdt . | |
| 4,231,486 | 11/1980 | Bock | 220/266 |
| 4,293,080 | 10/1981 | Letica . | |
| 4,308,970 | 1/1982 | Von Holdt . | |
| 4,380,304 | 4/1983 | Anderson . | |
| 4,380,305 | 4/1983 | Von Holdt . | |
| 4,452,382 | 6/1984 | Von Holdt . | |
| 4,512,493 | 4/1985 | Von Holdt . | |
| 4,512,494 | 4/1985 | Von Holdt . | |
| 4,574,974 | 3/1986 | von Holdt . | |
| 4,577,776 | 3/1986 | Rayner et al. | 220/789 |
| 4,667,843 | 5/1987 | Galer . | |
| 4,706,838 | 11/1987 | Von Holdt . | |
| 5,020,686 | 6/1991 | Dutt . | |
| 5,048,713 | 9/1991 | Tiveron . | |
| 5,181,626 | 1/1993 | Daenen et al. | 220/282 |
| 5,307,949 | 5/1994 | Von Holdt, Jr. | 220/276 |

*Primary Examiner*—Stephen Cronin
*Attorney, Agent, or Firm*—Banner & Witcoff Ltd

[57] ABSTRACT

A plastic container lid is adapted for openable attachment to a container. The lid comprises a main lid member having a peripheral, annular outer first wall. The lid also comprises an outer ring member carried on the annular outer wall of the main lid member in sealed but separable relation. The outer ring defines second and third spaced walls to form an annular space which receives the annular lip of a container in locking relation therewith. The main lid member is removable from and reattachable to the outer ring member by the user while carried on the annular container lip. Thus, the outer ring member effectively becomes part of the container, being attached by a permanent snap-fit connection, to improve the hoop strength of the container along with other advantages as described herein.

11 Claims, 2 Drawing Sheets

FIG.1
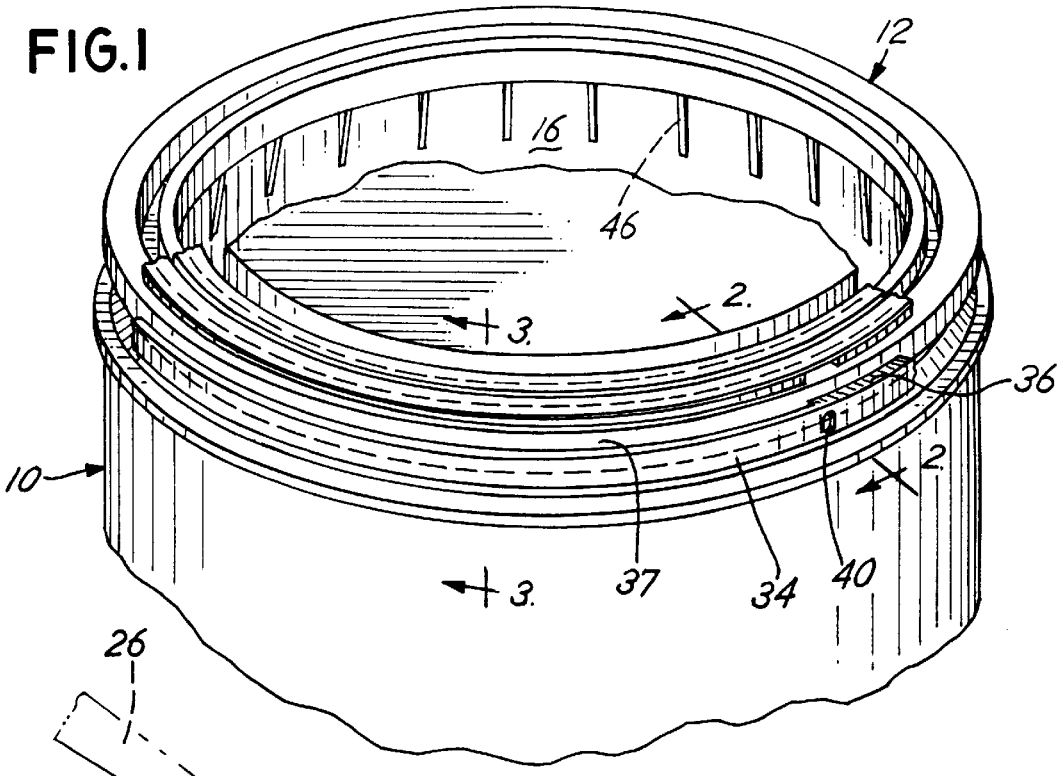
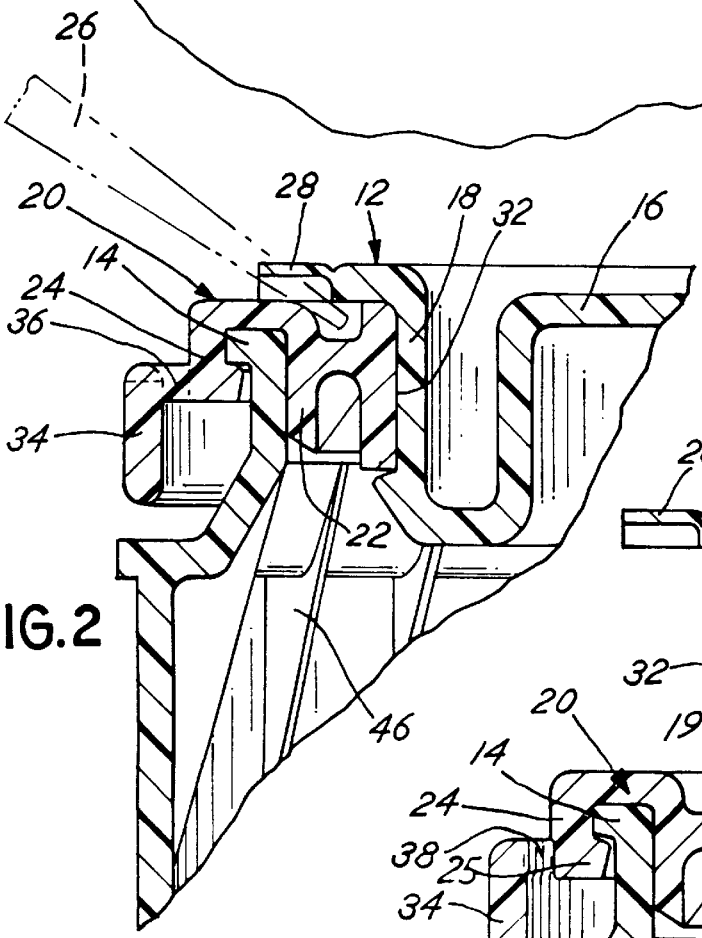
FIG.2
FIG.3
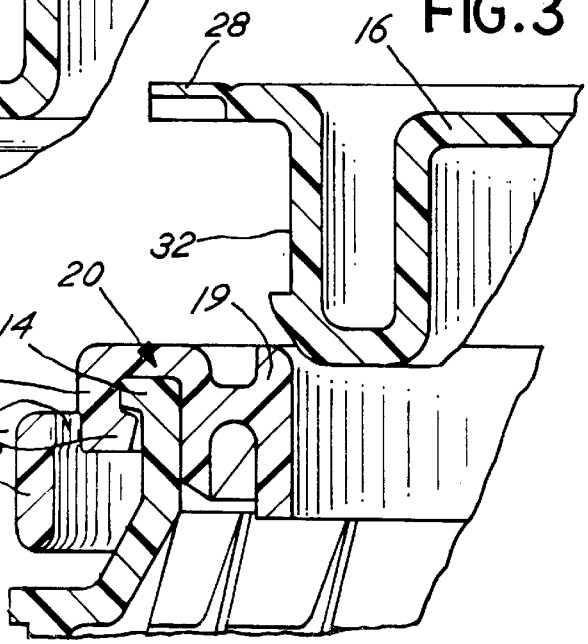

TWO PART PLASTIC CONTAINER LID

BACKGROUND OF THE INVENTION

Many designs of plastic bucket lids are well-known, see for example the following patents of John W. Von Holdt: U.S. Pat. Nos. 4,574,974; 4,512,494; 4,512,493; 4,452,382; 4,380,305; 4,308,970; and 4,210,258.

Many containers, such as cans for food, paint and other solvents and chemicals have also been made of plastic, as shown in the above-cited patents. However, plastic buckets of course lack the strength of metal buckets, so that in many cases special designs of the plastic buckets must be used to obtain, for example, a desired level of hoop strength about the mouth of the plastic bucket. This hoop strength is achievable in the prior art by reinforcement in some manner of the mouth area of the plastic bucket, typically involving an annular portion that projects radially inwardly, which reinforces the bucket.

However, buckets of this design require a collapsible core for their molding, which adds capital and operating expense to the operation, and also tends to slow the operation down. Likewise, collapsible cores are subject to failure and other problems, which further slows the efficiency of the operation.

In accordance with this invention, a plastic bucket lid is provided which can be used with a conventional plastic bucket which does not require manufacture by the use of a collapsible core. At the same time, the lid itself uniquely provides to the bucket a desired amount of hoop strength, even to a plastic bucket which is of the design of a conventional metal paint can or the like.

Additionally, the plastic bucket lid of this invention may carry the handle of the bucket and lid combination in an effective and reliable manner, without significant risk of breakage or dropping of the bucket, even though the handle is located on the lid.

DESCRIPTION OF THE INVENTION

In accordance with this invention, a plastic bucket lid is adapted for openable attachment to a container such as a bucket, comprising a main lid member and an outer ring member which is peripherally attached to the main lid member. The outer ring member may be typically permanently attached to the lip of the bucket, while the main lid member may be separated and then reattached within the outer ring member. Thus, when the main lid member is removed, access to the contents is available. At the same time, the outer ring member, typically permanently seated on the container lip and surrounding the container mouth, can greatly add to the hoop strength of the container adjacent the mouth. Additionally, the outer ring member typically projects inwardly from the container lip, to provide, for example, an annular site for wiping a paint brush in such a manner that the paint stays away from the outside of the container and does not flow down the side. Thus, a two piece container lid provides significant advantages.

Preferably, the main lid member defines a peripheral, annular, outer first wall. The outer ring member is carried on the annular, outer first wall in sealed relation to it. The outer ring member defines an inner, annular second wall and an outer, annular third wall, which are positioned to define an annular space between them to receive the annular lip of a bucket in locking relation. Typically this latter locking relation is a permanent lock.

The main lid member is removable from and reattachable to the outer ring member, to open and close the bucket, this being typically accomplished by the user while the outer ring member of the bucket lid is carried on the bucket lip.

In one embodiment, the outer ring member is separate from and removably carried by the main lid member in an annular recess which is defined by the annular, outer first wall of the main lid member. However, alternative ways of such removable physical connection may also be used. For example, the annular, outer first wall may define a projection, annular or otherwise, which engages a recess of the outer ring member for similar attachment.

As an alternative embodiment, the outer ring member may comprise an inwardly extending, annular projection that is originally attached to the outer first wall by an annular tear membrane. This may be accomplished by molding the entire plastic bucket lid as an integral piece, so that the annular tear membrane is simply a thin, integral portion of the entire, molded lid. This, the main lid member may be torn away from the outer ring member by simply pulling the lid or otherwise tearing the annular tear membrane.

Then, to replace the main lid member to reclose the container, the outer first wall of the main lid member comprises an annular recess which is spaced from the tear membrane. The main lid member is replaced, and pressed so that the inwardly extending, annular projection of the outer ring member is received in the annular recess in a typically snap-fit relationship, upon reattachment of the main lid member to the outer ring member. Thus, a seal may be provided on reattachment of the main lid member. The main lid member is furthermore removable as desired from its new, secondary sealing position within the outer ring member.

Also, the lid of this invention may further define at least one elongated, flexible handle member which is integrally attached to the lid at opposed ends of the handle member. The handle member also may be attached to the lid at at least one point along the handle member, which is spaced from the handle member ends, by a manually breakable integral connection. Thus, the user can break that manually breakable, integral connection, and pull up a handle which is an integrally molded part of the plastic lid, and preferably is carried by the outer ring member. The handle member, in turn, carries the entire bucket. However, the handle member may also be placed on the main lid member if that is desired, particularly where lighter loads are contemplated, with less risk of accidental separation of the main lid member from the bucket and outer ring.

Preferably, a pair of such flexible handle members may be integrally attached to the lid at their opposed ends, and preferably to the outer ring member.

Thus, the lid of this invention, which can comprise a single, molded piece, also may include the handle (or handles) which lifts both the lid and the bucket to which the lid is attached. This permits the manufacture of buckets of simpler design, and particularly eliminates the need for a separate metal bail on the bucket, and the molding side action needed to form the bail sockets on the bucket, or the molded bail itself.

As another embodiment, the outermost, annular third wall of the lid may carry an integral, first handle member which is positioned radially outwardly from the third wall and is integrally attached to the third wall at about the opposed handle ends. The first handle member defines apertures which are adjacent the handle ends and penetrate therethrough. Each aperture is positioned between a breakable handle portion and a pivoting handle portion of the handle member, whereby breaking of the breakable handle portions permits the pivoting of the handle member by flexing action about the pivoting portions.

Thus the first handle member, prior to breaking of the breakable handle portions, tends to be held in a single, desired position out of the way, for stacking of the container. After such breaking, which can be conveniently done with a screw driver or the like, the handle can swing upwardly to lift the lid and the bucket to which it is attached.

Preferably, the outer ring member of the lid of this invention defines a radial thickness which is no more than half the diameter of the main lid member. The radial thickness basically represents the outer diameter of the outer ring member, minus the diameter of the aperture which is surrounded by the outer ring member.

Thus a bucket and lid system of improved hoop strength is provided, without the need for manufacture of the bucket with a collapsible core. Also, a bail handle attached to the bucket can be eliminated, with the handle being integral with and carried by the bucket lid.

DESCRIPTION OF DRAWINGS

In the drawings, FIG. 1 is a perspective view of one embodiment of the lid of this invention, carried on a plastic bucket;

FIG. 2 is a sectional view taken along line 2—2 of FIG. 1;

FIG. 3 is a sectional view taken along line 3—3 of FIG. 1 with the main lid member removed;

DESCRIPTION OF SPECIFIC EMBODIMENTS

Figure 5:
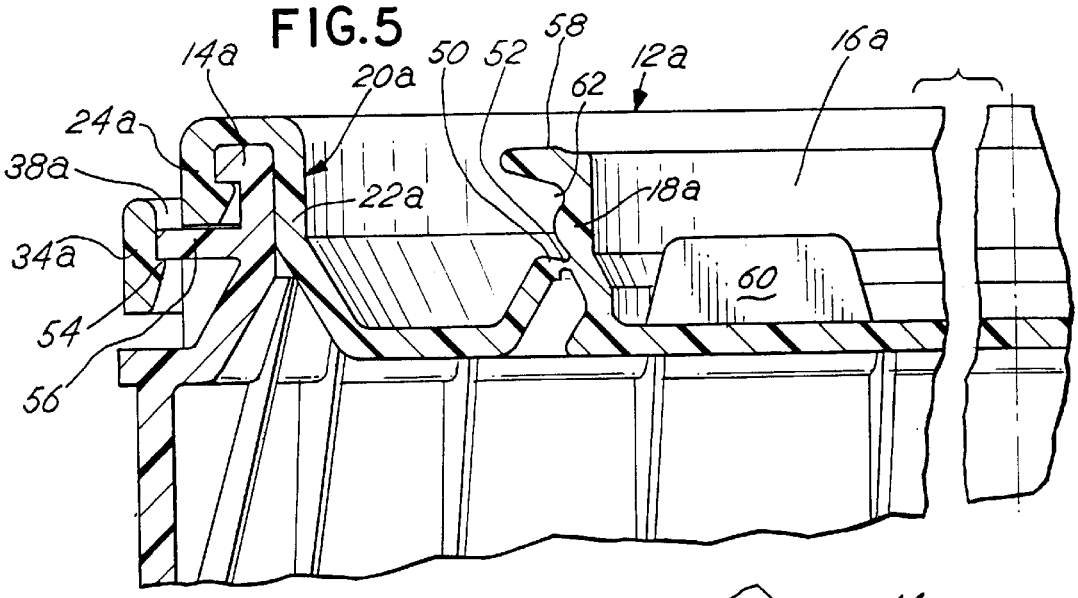
FIG. 5 is a fragmentary, longitudinal sectional view of a bucket lid, attached to a bucket, showing another embodiment of this invention.

Referring to FIGS. 1 through 4, a plastic bucket 10 of a typical design for a paint bucket, is shown to carry an attached lid 12 which is constructed in accordance with this invention. Bucket 10 defines a conventional bucket lip 14 to which lid 12 is attached.

Lid 12 defines a central, main lid member 16 which defines a peripheral, annular, outer first wall 18. Lid 12 also defines an outer ring member 20 which is carried on the annular, outer wall 18 in a sealed but separable, mechanical connection.

Outer ring member 20 defines an inner, annular second wall 22 and an outer, annular third wall 24 with a radially inwardly projecting lip 25 for retaining the ring member 20 on the container lip 14. The second and third walls 22, 24 are positioned to define an annular space between them which is shown to receive the annular lip 14 of bucket 10 in locking relation therewith, as particularly shown in FIG. 2, for example.

In accordance with this invention, main lid member 16 is thus removable and reattachable to the outer ring member 20 by the user, while the outer ring member is carried on the annular bucket lip 14. This removal of main lid member 16 may be accomplished by the use of a screw driver 26 or the like, which can project in under tamper-indicating flap 28, to pry upwardly against flange 30 to cause separation of outer ring member 20 from annular recess 32 defined in first wall 18. Thus, main lid member 12 can be removed, with the outer ring member effectively becoming a permanent part of the bucket 10, retained by lip 25, to provide the desired improved hoop strength to the bucket without the molding difficulties encountered with collapsible cores.

Also, if the bucket is intended for paint or the like, during use the paint brush is wiped on the radially innermost portion 19 of outer ring 20, which can be well spaced from the exterior of the bucket. Thus the spilling of paint during painting operations is reduced.

Overlying member 28 can serve as a tamper indication, in that it can be adapted to tear when the screw driver 26 is inserted for removing main lid member 16, while outer ring member 20 remains permanently secured to the bucket.

Also, a handle 34 is integrally molded as part of lid 12. Handle 34 is shown in FIGS. 1 and 2 to be carried on the outer, annular third wall 24, being integral therewith through a plastic connection 36 positioned at the respective ends of handle 34. Typically, handle 34 will extend around the circumference of lid 16 by a distance on the order of 180°.

FIG. 2 shows the end area of handle 34 where the plastic portion 36 exists to integrally connect handle 34 with the rest of outer ring member 20. As shown by FIG. 3, there is no connection like portion 36 along the majority of the intermediate portion of handle 34, but rather a space 38 is positioned where plastic portion 36 resides in the view of FIG. 2.

Figure 4:
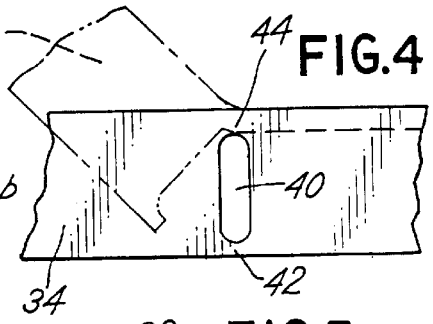
FIG. 4 is an enlarged, elevational view, with portions eliminated, of a portion of the handle member of the bucket of FIG. 1, showing how the handle member can be released to pivot upwardly.

At each end of handle 34 an aperture 40 is provided, each aperture being positioned between a breakable handle portion 42 and a pivoting or hinge handle portion 44 (FIG. 4). When the container is made of an appropriate polyolefin or the like, pivoting handle portion 44 may act like a "living hinge" so that, when breakable portions 42 are broken away by a screw driver or the like by reaching into apertures 40, handle 34 can then be pivoted upwardly as shown in phantom lines of FIG. 4. Thus, the simple cutting action at both ends by the screw driver frees handle member 34, and allows it to be pivoted upwardly for use as a bucket handle.

It should also be noted that handle 34 is carried on plastic lid 12, and specifically on annular outer wall 20, which is typically intended for permanent attachment to bucket 10. Thus, no bail is required with the bucket, and yet handle 34 can serve as a reliable handle which is not readily detached, since outer ring member 20 can be effectively permanently attached to buckets 10 if desired by its design of attachment.

Also, the interior of bucket 10 may carry strengthening ribs 46, as shown, to provide further hoop strength, along with the presence of outer ring member 20.

FIG. 4 shows handle 34 in its raised configuration after breaking of the respective, breakable handle portions 42 at the respective ends of the handle.

Thus, by the embodiment of FIGS. 1–4, a molded container may be equipped with a lid 12 which comprises two mating, separable parts 16, 20, with the attachment to the container being at part 20. From then on, part 20 typically becomes an effectively permanent part of the bucket, optionally equipped with an integral handle, while the main lid member 16 is readily removable and replaceable by a snap-fit construction, the design of which per se may be known to the art in other technical applications.

Referring to FIG. 5, a related design of lid 12*a* for a bucket 10*a* is disclosed. Lid 12*a* comprises, as before, a main lid member 16*a*, and an outer ring member 20*a* carried on first, annular, outer wall 18*a* of the main lid member 16*a*. However, in this embodiment, outer ring member 20*a* comprises an inwardly extending, annular projection 50 that is attached to the first, annular, outer wall 18*a* by an annular tear membrane 52. The entire lid comprising the main lid member 16*a* and the outer ring member 20*a* may thus be manufactured in a single shot of an injection mold, which eliminates the assembly step typically necessary in the embodiment of FIG. 2 to assemble the respective lid parts 16, 20 after they have been separately molded.

Outer ring member 20*a* comprises, as before, inner, annular second wall 22*a* and outer annular third wall 24*a*, to receive, as before, the lip 14*a* of plastic bucket 10*a*. A handle member 34*a*, similar in design to handle member 34 of FIGS. 1–4, is carried by the third annular wall 24*a* in a manner similar to the previous embodiment, the particular sectional view of FIG. 5 being from the viewpoint of FIG. 3, so that a space 38*a* is shown between handle 34*a* and third annular wall 24*a* in the particular view.

Also, handle 34*a* defines an inner notch 54, which can engage outwardly extending flange 56 of bucket 10*a*. Thus, the handle 34*a* may be retained in a lowered configuration by such engagement until the user is ready to raise the handle for use by pulling the bottom of the handle outwardly and peeling it away from flange 56 to cause disengagement of notch 54.

For use, lid 12*a* can be placed by automatic capping machinery onto bucket 10*a* after the bucket has been filled with a desired contents. Handle 34*a* may be elevated at any time, as desired.

To open the container, one can simply strike the outwardly extending annular platform 58 defined by annular, first wall 18*a*, to break annular tear membrane 52. One may grip upstanding rib 60 with pliers or the like to facilitate the removal of main lid member 16*a*, so that inwardly extending annular projection 50 becomes the innermost portion of the lid after opening. This inwardly extending portion serves as a good wiper for paint brushes and the like.

The diameter of main lid member 16*a* compared with the radial thickness of outer ring member 20*a* is such that the outer ring member has a radial thickness which is preferably no more than half the diameter of the main lid member, and typically substantially less than that.

Then, when it is desired to reclose the container, main lid member 12*a* may be returned to its position as shown in FIG. 5, then being pushed farther downwardly until annular, inwardly extending projection 50 engages into the annular recess 62 of first wall 18*a*. There, a temporary retention and seal can be provided, until it is desired once again to reopen the container lid.

Figure 6:
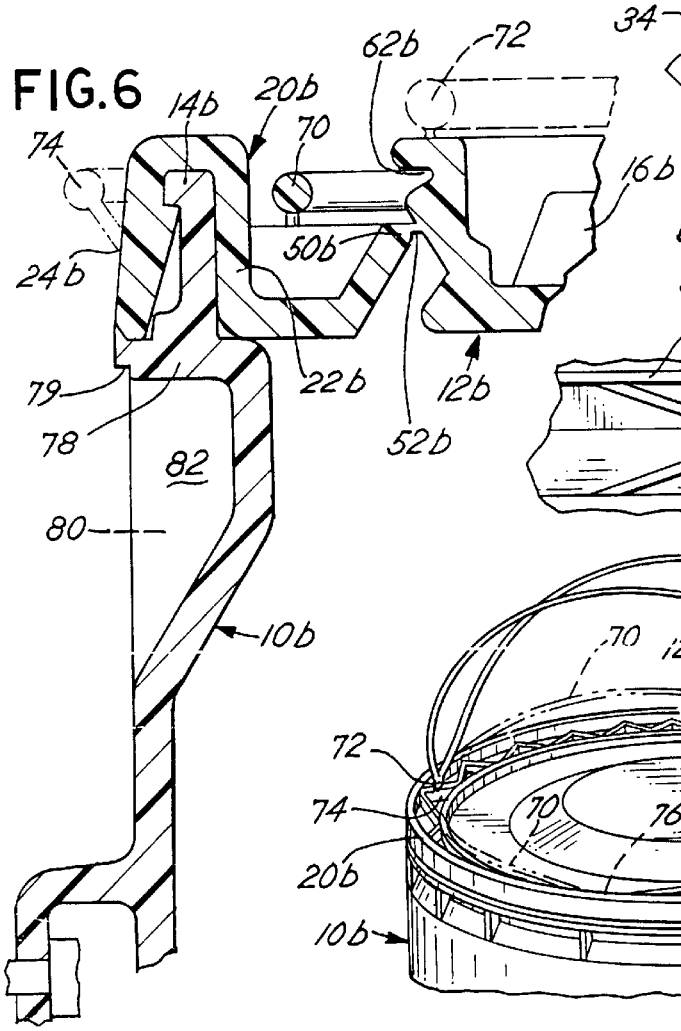
FIG. 6 is a fragmentary, longitudinal sectional view of a third embodiment of a bucket lid in accordance with this invention, the lid being shown attached to a bucket.
Figure 7:
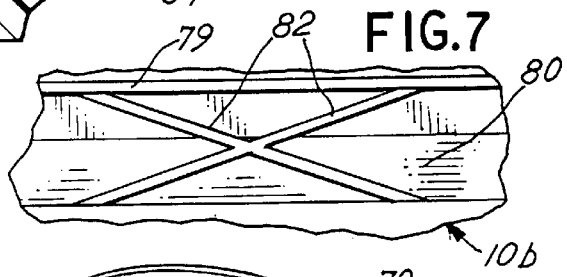
FIG. 7 is an enlarged, fragmentary elevational view of an outside portion of the bucket of FIG. 6.
Figure 8:
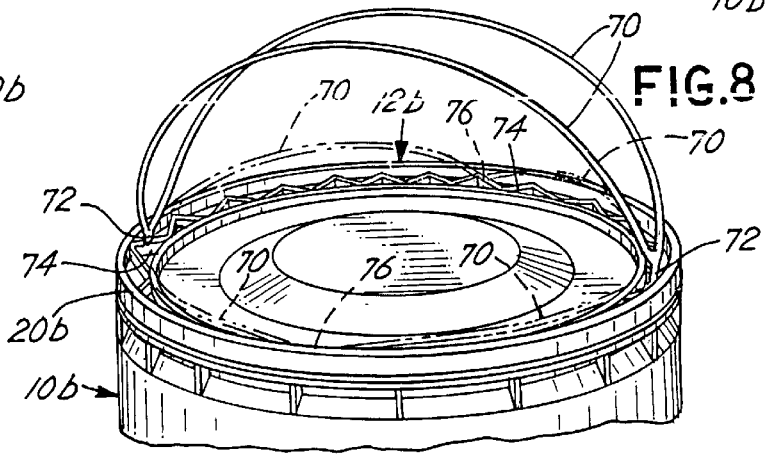
FIG. 8 is a perspective view of the bucket lid and bucket of FIG. 6, showing one embodiment of the integral handle member attached to the lid.

Referring to FIGS. 6–8, a plastic container 10*b* is shown to carry a lid 12*b*. Lid 12*b* may be made by injection molding in a single shot, as may container 10*b*. Lid 12*b*, as before, comprises a central, main lid member 16*b* and an outer ring member 20*b*. Outer ring member 20*b* defines, as before, an inner, annular second wall 22*b* and an outer, annular third wall 24*b*, to define an annular space therebetween to receive annular lip 14*b* of bucket 10*b*.

As in the embodiment of FIG. 5, main lid member 12*b* and outer ring member 20*b* are connected together by an annular tear membrane 52*b*, so that main lid member 12*b* may be torn loose and then replaced, with inwardly extending annular projection 50*b* being held within annular recess 62*b*, as in the embodiment of FIG. 5.

By this invention, lid 12*b* carries an integral, elongated, flexible handle member 70, 72, or 74, with only one of the handle members 70, 72, or 74 being typically present. The three handle members are shown on the same lid primarily for purposes of illustration, although multiple handles may be used if desired.

Referring to FIG. 8, a view of container 10*b*, having lid 12*b* carried thereon, is shown in perspective, with a pair of handles 70 being shown attached to outer ring member 20*b* in accordance with this invention. Each handle 70 comprises a flexible rod of plastic, molded simultaneously with the rest of lid 12*b*, with each end of each handle 70 connecting through an integral neck portion 72 to a vane 74, the vanes being provided in a recess of outer ring member 20*b* to provide stiffness. Also, each of handles 70 in initial, as-molded condition is held to a rib 74 at one or more points along the length of handle 70 by one or more frangible seals 76, which may be created by the integral molding process (FIG. 8-in phantom). These seals may be broken by manually pulling the unconnected portions of handle 70, so that the handle can be initially in flat configuration against lid 12*b*, but then can be pulled outwardly to function as a handle as shown in FIG. 8 in full lines. The corresponding alternate handles 72, 74 of FIG. 6 can be similarly attached to lid 12*b*.

It should be noted that handle 72 connects to the removable main lid member 16*b*, so it should not be relied on for lifting of the entire bucket unless the contents are very light.

Bucket 10*b* also defines an outwardly projecting annular flange portion 78, which carries bucket lip 14*b* and forms part of a recess 80, which recess is occupied by strengthening ribs 82. A label may be attached with its top in notch 79, resting on ribs 82.

FIG. 7 shows that ribs 82 may be arranged in a criss-cross manner, to provide added strengthening of the mouth area of container 10*b*.

Thus, by this invention, container 10*b* may be manufactured without the need for a collapsible core, but may still exhibit a great deal of hoop strength even if it is made out of plastic, due to the reinforcing action of criss-cross ribs 82 and the outer ring member 20*b*, which may be permanently carried on the bucket lip 14*b* once lid 12*b* has been attached to the container. If desired, the handle for the bucket and lid may be connected to outer ring member 20*b* in the form of either handle 70 or handle 74, for example. Main lid member 16*b* may also be equipped with a handle 72. The main lid member 16*b* and the outer ring member 20*b* may be connected together in any desired manner, either by having been integrally molded together with a tear ring 52 or 52*b* to separate them, or by separate molding and a snap-fit arrangement as exemplified in FIGS. 2 and 3.

The container and lid of this invention may be used for any desired purpose, with reduced manufacturing and handling costs, while retaining the ability for stacking.

The above has been offered for illustrative purposes only, and is not intended to limit the scope of the invention of this application, which is as defined in the claims below.

That which is claimed:

1. A plastic lid adapted for openable attachment to a container, which comprises, in combination:

a main lid member which defines a peripheral, annular outer first wall, and an outer ring member carried on said annular outer wall in sealed but separable relation, said outer ring member defining an inner, annular second wall and an outer, annular third wall positioned to define an annular space between said second and third walls to receive the annular lip of a container in locking relation, said main lid member being removable from and reattachable to said outer ring member by the user while said lid is carried on said annular container lip, said outer annular third wall including a radial inward projecting lip for retaining the outer ring member on a container lip.

2. A plastic lid adapted for openable attachment to a container, which comprises, in combination:

a main lid member which defines a peripheral, annular outer first wall with an overlying member extending radially outwardly therefrom, and an outer ring member carried on said annular outer wall in sealed but separable relation, said outer ring member defining an inner, annular second wall and an outer, annular third wall positioned to define an annular space between said second and third walls to receive the annular lip of a container in locking relation, said main lid member being removable from and reattachable to said outer ring member by the user while said lid is carried on said annular container lip, said overlying member of the main lid member extending over the innermost portion of the outer ring member and including at least a portion thereof which will tear when impinged by a tool to indicate that the main lid member has been opened or subjected to tampering.

3. A plastic container lid adapted for attachment to a container, which comprises, in combination:

a main lid member, and a removably attachable outer ring member, said outer ring member defining an inner, annular second wall and an outer annular third wall positioned to define an annular space between the second and third walls, to receive the annular lip of a container in locking relation, said outer ring member carrying an integral handle member which is integrally attached to said ring member adjacent opposed handle ends, said handle member being positioned radially outwardly from said third wall, said handle member defining apertures adjacent said handle ends, each aperture being positioned between a breakable handle portion and a pivoting handle portion of said handle member, whereby breaking of the breakable handle portions permits pivoting of said handle member about said pivoting portions.

4. The plastic lid of claim 3 in which said handle member is positioned radially outwardly from said third wall, said handle member defining apertures adjacent said handle ends, each aperture being positioned between a breakable handle portion and a pivoting handle portion of said handle member, whereby breaking of the breakable handle portions permits pivoting of said handle member about said pivoting portions.

5. A plastic lid adapted for openable attachment to a container, which comprises, in combination:

a main lid member which defines a peripheral, annular outer first wall, and an outer ring member carried on said annular outer wall in sealed but separable relation, said outer ring member defining an inner, annular second wall and an outer, annular third wall positioned to define an annular space between said second and third walls to receive the annular lip of a container in locking relation, said main lid member being removable from and reattachable to said outer ring member by the user while said lid is carried on said annular container lip, said outer, annular third wall having an integral, first handle member positioned radially outwardly from said third wall and integrally attached to said third wall adjacent opposed handle ends, said first handle member defining apertures adjacent said handle ends, each aperture being positioned between a breakable handle portion and a pivoting handle portion of said handle member, whereby breaking of the breakable handle portions permits pivoting of said handle member about said pivoting portions.

6. The plastic lid of claim 5 in which said outer ring member is removably carried in an annular recess defined by said annular, outer first wall.

7. The plastic lid of claim 5 in which said outer ring member defines a radial thickness which is no more than half the diameter of said main lid member.

8. The plastic lid of claim 5 which further defines at least one elongated, flexible handle member integrally attached to said lid at opposed ends of said handle member.

9. The plastic lid of claims 5 or 3 wherein the main lid member and the outer ring member are separate members.

10. The plastic lid of claims 5 or 3 wherein the outer, annular third wall includes a radial inwardly projecting lip for retaining the outer ring member on a container lip.

11. The plastic lid of claims 5 or 3 wherein the main lid member further includes an overlying member extending radially outward from the annular first wall over the innermost portion of the outer ring member, said overlying member including at least a portion which will tear when impinged by a tool to indicate that the main lid member has been previously removed or subjected to tampering.

* * * * *